US006640730B2

(12) United States Patent
Tsai

(10) Patent No.: US 6,640,730 B2
(45) Date of Patent: Nov. 4, 2003

(54) TABLE

(76) Inventor: Ming-Liang Tsai, 4F-3, No. 8, Fu Ching St., Taipei (TW)

( * ) Notice: Subject to any disclaimer, the term of this patent is extended or adjusted under 35 U.S.C. 154(b) by 0 days.

(21) Appl. No.: 10/003,316

(22) Filed: Dec. 6, 2001

(65) Prior Publication Data

US 2003/0106476 A1 Jun. 12, 2003

(51) Int. Cl.[7] ..... A47B 3/00
(52) U.S. Cl. ..... 108/115; 108/181
(58) Field of Search ..... 108/157.18, 115, 108/157.1, 181, 163, 35, 67; 248/188, 188.1; 403/233, 234; 135/145, 131, 141, 151

(56) References Cited

U.S. PATENT DOCUMENTS 1,262,356 A * 4/1918 Kirkland ..... 108/159
3,770,106 A * 11/1973 Kuehl et al. ..... 198/793
6,026,751 A * 2/2000 Tsai ..... 108/115
6,079,338 A * 6/2000 Yeh ..... 108/115
6,112,757 A * 9/2000 Tseng ..... 135/145
6,234,089 B1 * 5/2001 Zheng et al. ..... 108/115
6,283,045 B1 * 9/2001 Izumi ..... 108/115

* cited by examiner

*Primary Examiner*—Lanna Mai
*Assistant Examiner*—Jerry A. Anderson
(74) *Attorney, Agent, or Firm*—Rosenberg, Klein & Lee

(57) ABSTRACT

A table comprises a tabletop, joints, legs, a connecting device and auxiliary supporting devices, the tabletop is formed with pipes and rails, the rails are formed on two sides of each pipe, perpendicularly, and every two rails are connected by the joint, each joint is formed by a pair of blocks, with one block secured to the rail and the other block slidably attached to the rail, the legs are connected by the auxiliary supporting devices to support the tabletop.

2 Claims, 8 Drawing Sheets

TABLE

BACKGROUND OF THE INVENTION

1. Field of the Invention

This invention relates to a table, and more particular to a table with a foldable tabletop.

2. Description of the Prior Art

This applicant had applied an application, and received the patent previously, with a U.S. Pat. No. 6,026,751, which is also related to a foldable table, however, it still possesses some shortcomings:

1. The tabletop is formed by a number of plates, and every two adjacent plates are connected by a pair of connecting device and pivot, which is costly.
2. The tabletop is formed by assembling a number of plates together, the joint area has gaps.
3. The supporting areas for the tabletop are merely top heads of four legs, which structure is too weak that may not support too heavy objects on it.

SUMMARY OF THE INVENTION

It is the primary object of the present invention to provide a table, which tabletop is formed by a number of pipes connected and the joint areas are seamless.

It is another object of the present invention to provide a table, which is easy to carry when folding into a compact one.

It is a further object of the present invention to provide a table, which has a strong structure.

DESCRIPTION OF THE PREFERRED EMBODIMENT

Figure 1:
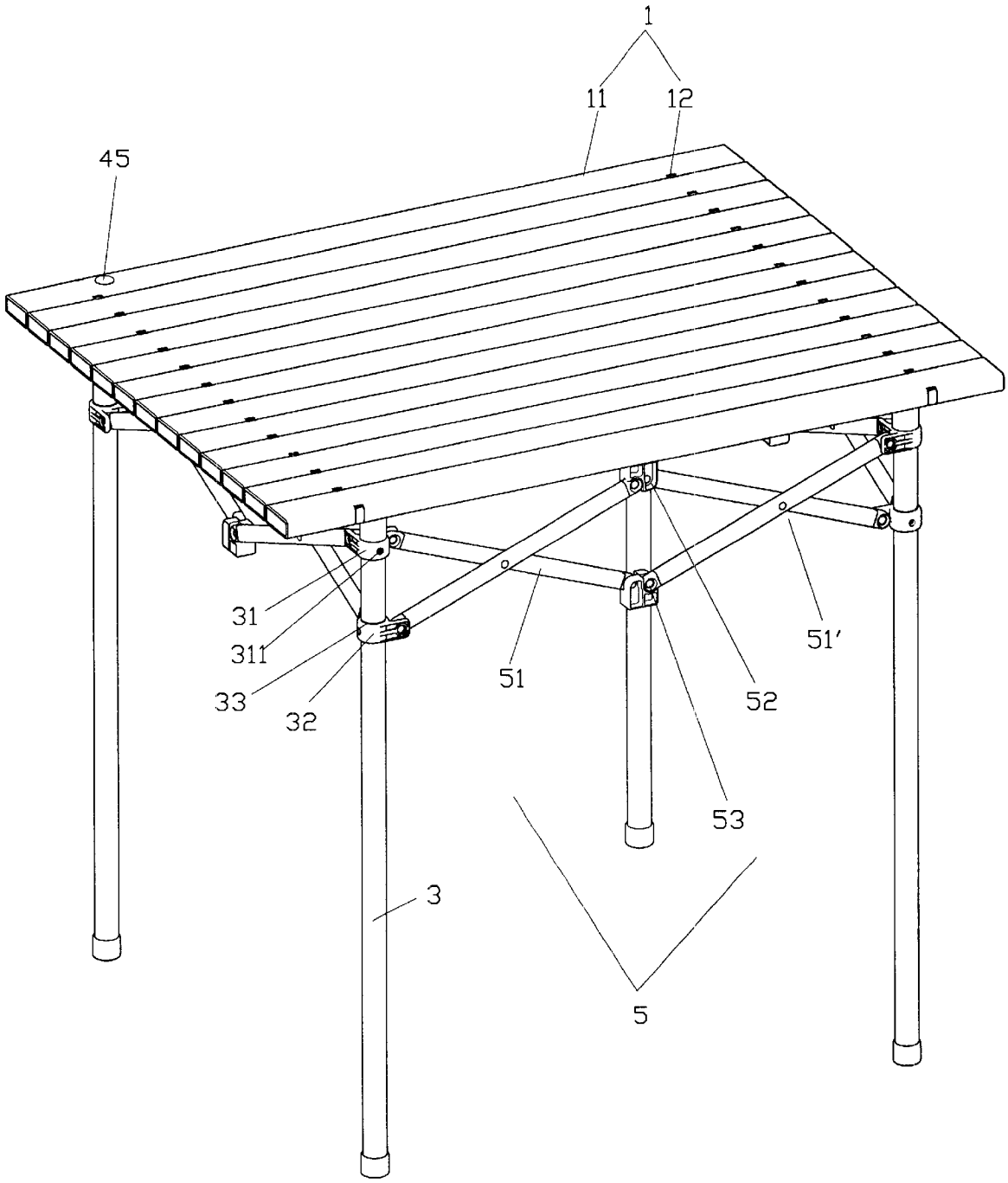
FIG. 1 is a perspective view of the present invention.

The table of the present invention, as shown in FIGS. 1 through 5, comprises a tabletop 1 supported by a number of legs 3 and auxiliary supporting devices 5 in an open status, to fold the table, simply collapse the legs 3 and auxiliary supporting devices 5, and fold the tabletop 1. The table further comprises a number of joints 2, and a connecting device 4.

The tabletop 1 is formed by a number of pipes 11 and rails 12 which connect the pipes 11 together. Each rail 12 has a hollow body with a slot 121 there on, and each pipe 11 has a pair of apertures 111 at respective ends perpendicularly for the rails 12 to extend therein. The rails 12 are inserted into the apertures 111 and secured with fasteners 112 to combine the pipes 11 together forming the tabletop 1. One of the pipes 11 of the tabletop 1 has a hole 13. Every two adjacent rails are connected by a joint 2 thereat.

The joint 2 is formed by connecting a pair of blocks 21 and 22 together, the first block 21 is secured to the rail 12 with a fastener 121, while the other block 22 comprises a number of locating apertures 221 and one of the locating apertures 221 is secured with a fastener 222 to the slot 121 of the rail 12 in a slidably manner.

The legs 3 are used to support the tabletop 1, each leg 3 has a pair of sleeves 31 and 32 equally spaced from each other for connection of the auxiliary supporting devices 5 thereat. One sleeve 31 is secured to a leg 3 by a fastener 311, while the other sleeve 32 is slidably attached to the leg 3. A rib 33 on the leg 3 limits movement of the sleeve 32. Three of the legs 3 comprise a head 34 on the top, while the fourth leg 3 has a connecting device 4 on the top which connects the tabletop 1 and allows the tabletop 1 to rotate.

The connecting device 4 comprises a connector 41, a pair of bolts 42 and 43, two washers 44 and a lid 45. The bolt 42 has an aperture 421 at one end portion. The connector 41 has a seat 411 on the top for the bolt 42 to extend along with the washers 44 there through, while the other bolt 43 is inserted transversely through the seat 411 and intercourse with the aperture 421 of the bolt 42, thus the bolt 42 is able to bring the tabletop 1 to rotate. The top end of the bolt 42 exposing from the tabletop 1 is capped with the lid 45.

Each auxiliary supporting device 5 is connected in between two legs 3 as the control mechanism to open and close the legs 3. Each auxiliary supporting device 5 is formed with a pair of posts 51 and 51' in a cross connection, with the connecting areas of each post 51 or 51' secured with a pair of blocks 52 and 53, while the other ends of the posts 51 and 51' are secured to the sleeves 31 and 32, respectively. By activating the auxiliary supporting devices 5, the sleeves 32 slide along the legs 3, simultaneously.

In assembly, the tabletop 1 is rotated along the connecting device 4, and the legs 3 are expanded, which brings the sleeves 32 to slide along the legs 3 and slide the auxiliary supporting devices 5 along the legs 3, as well, until the sleeves 32 reach the ribs 33, thus the legs 3 have reached to there limits, and are stabled in position, the tabletop 1 is flipped upwards, so that it seats on tops of the heads 34 and the blocks 52. There are eight points engaging with the tabletop 1, the table is stronger than prior arts.

Figure 2:
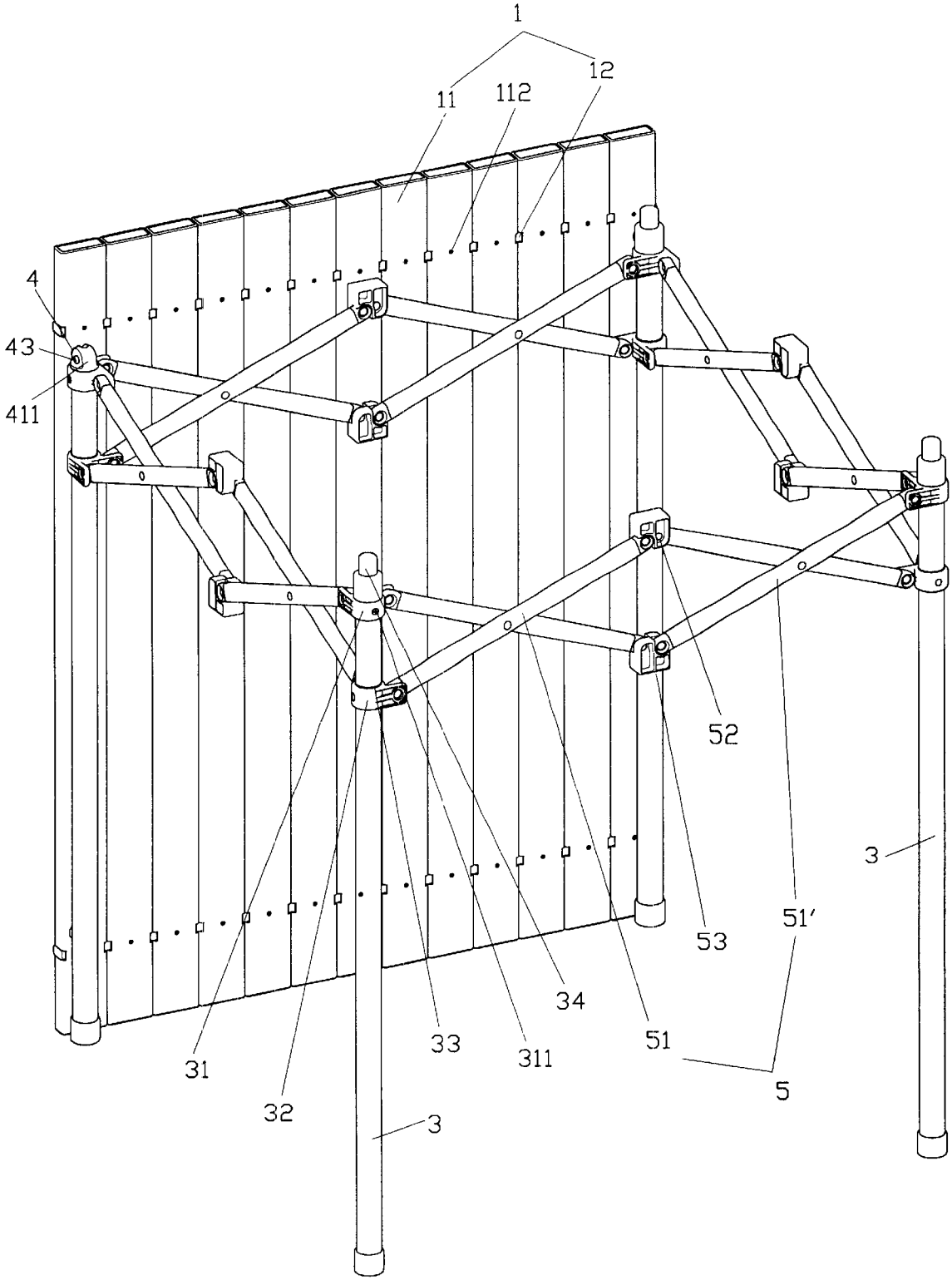
FIG. 2 is a perspective view showing the tabletop being flipped over to one side of the legs.
Figure 3:
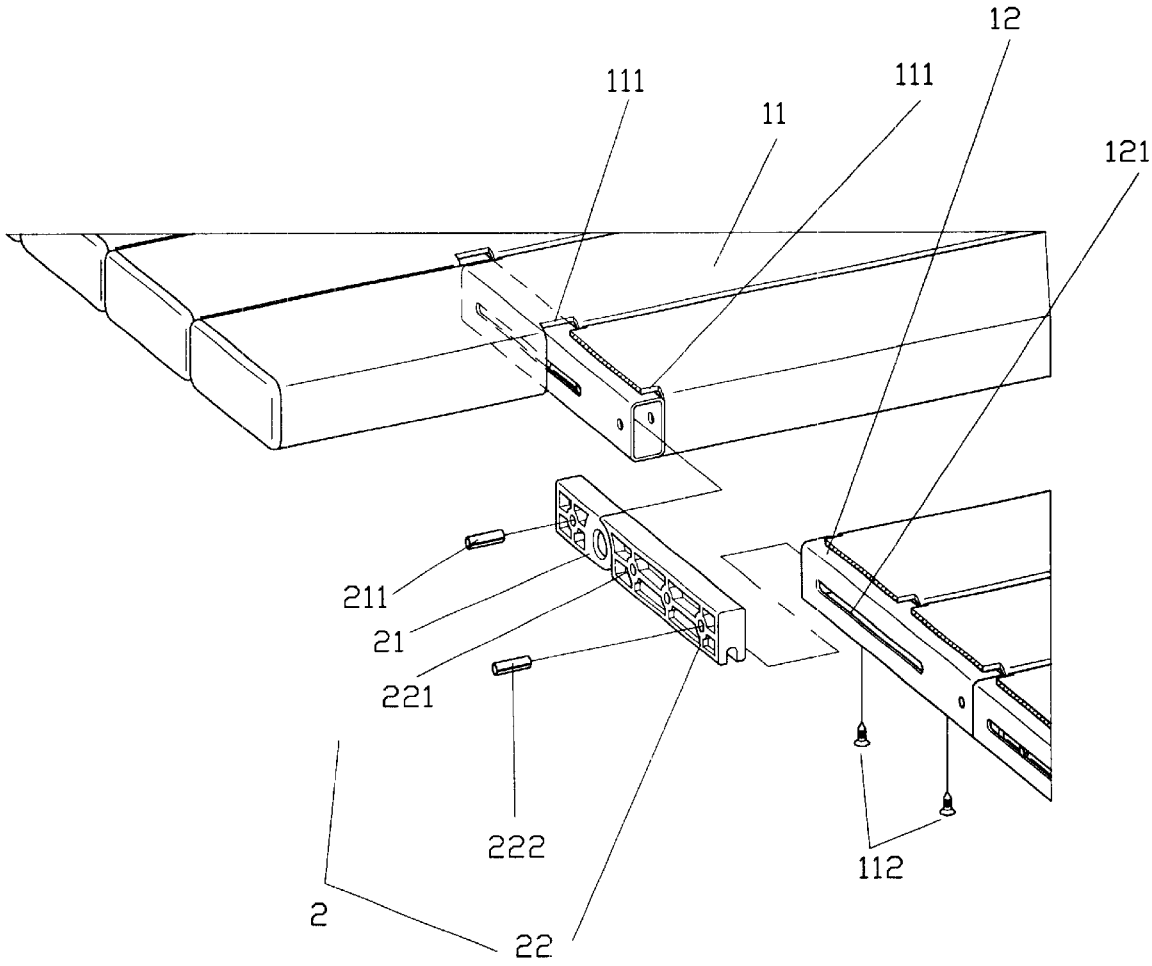
FIG. 3 is an enlarged view of the tabletop of the present invention.
Figure 4:
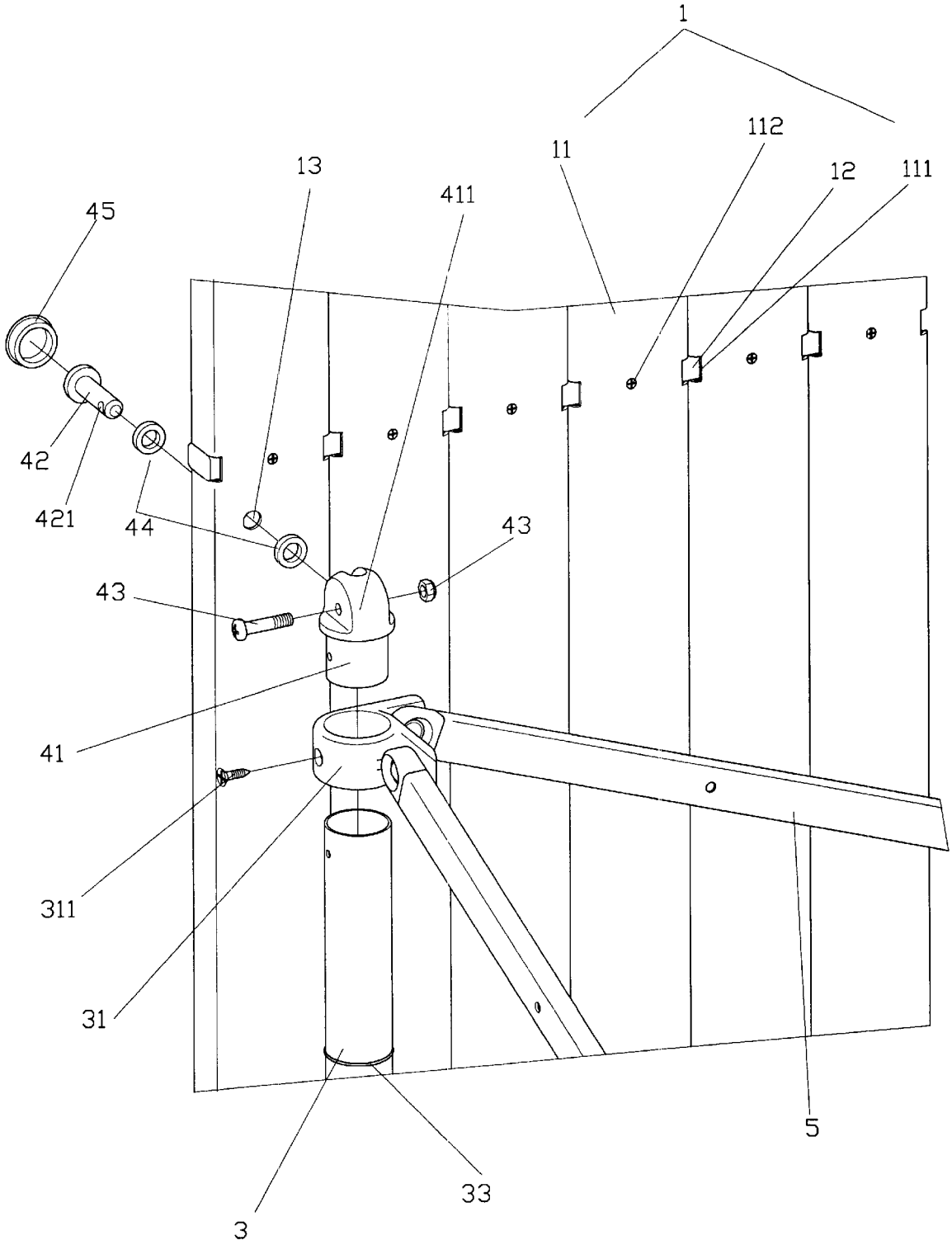
FIG. 4 is a view showing disengagement of a connecting device of the present invention.
Figure 5:
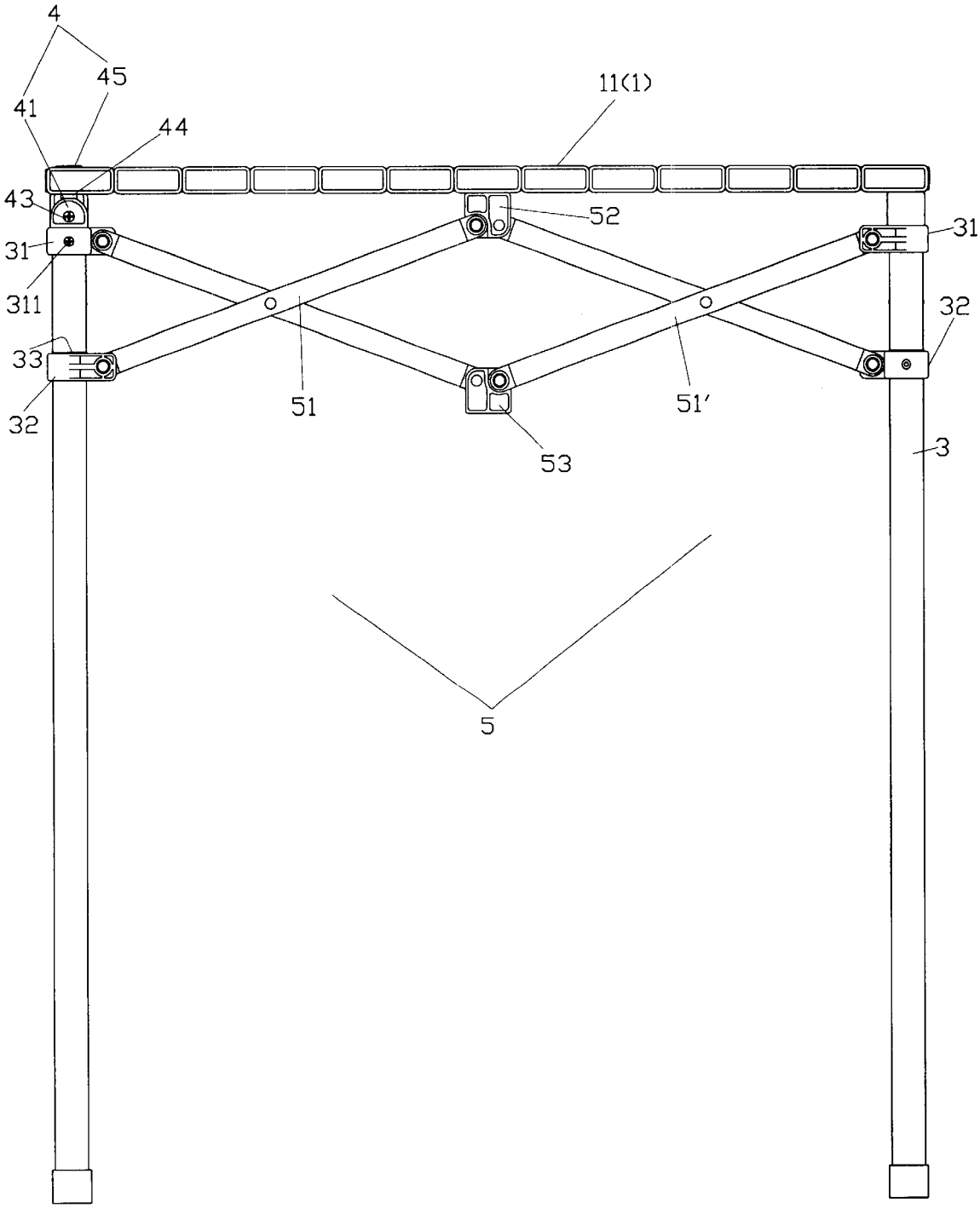
FIG. 5 is a view showing the present invention in an open status.
Figure 6:
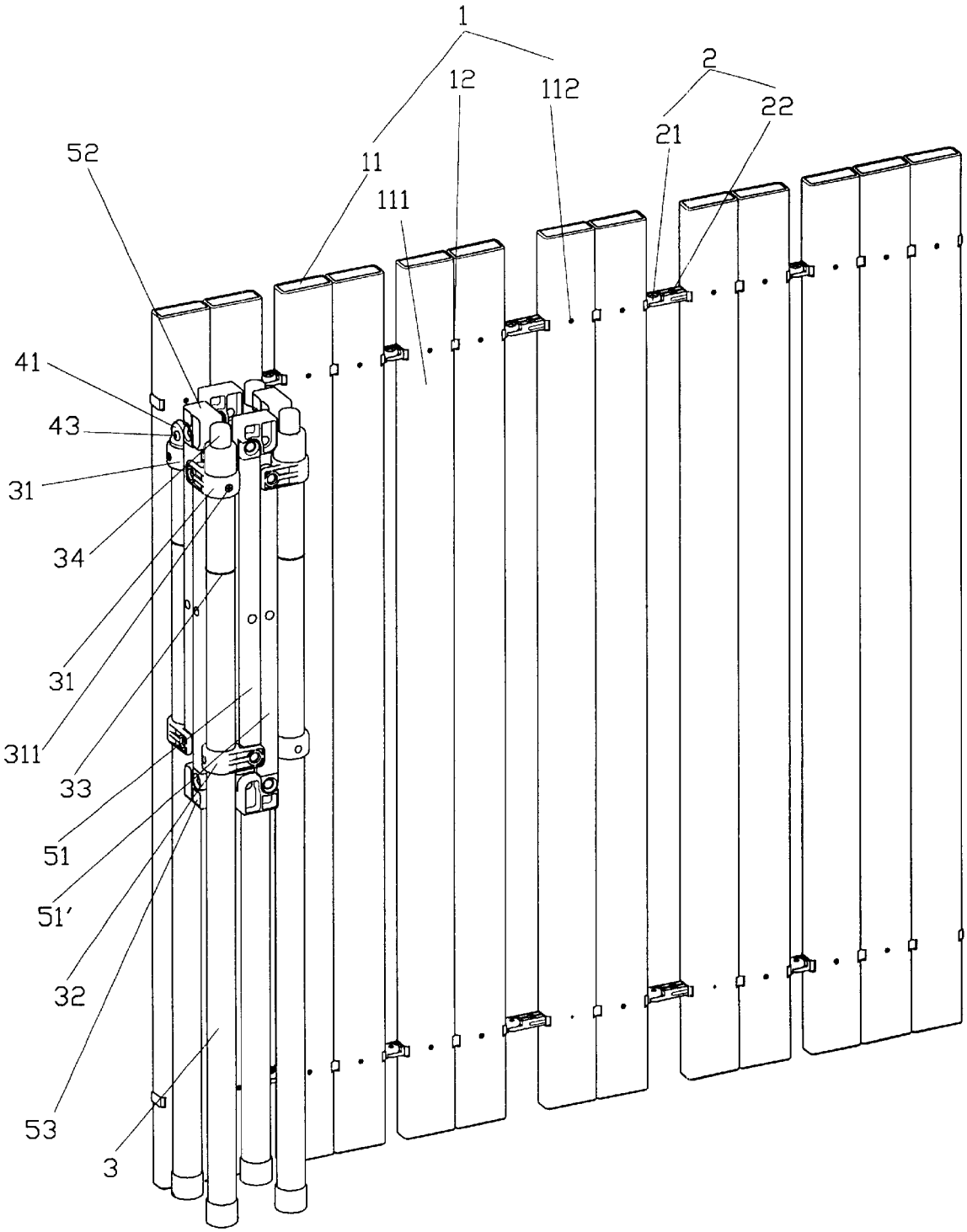
FIG. 6 is a view showing folding of the legs of the present invention.
Figure 7:
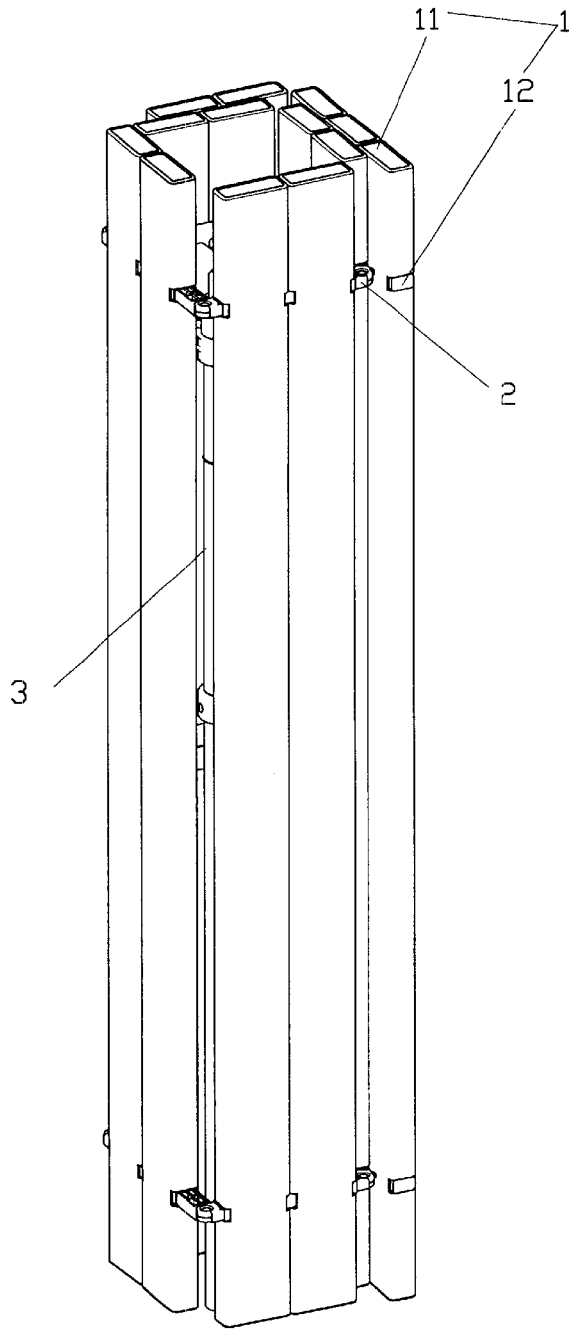
FIG. 7 is a view showing the legs are covered by the folded tabletop.
Figure 8:
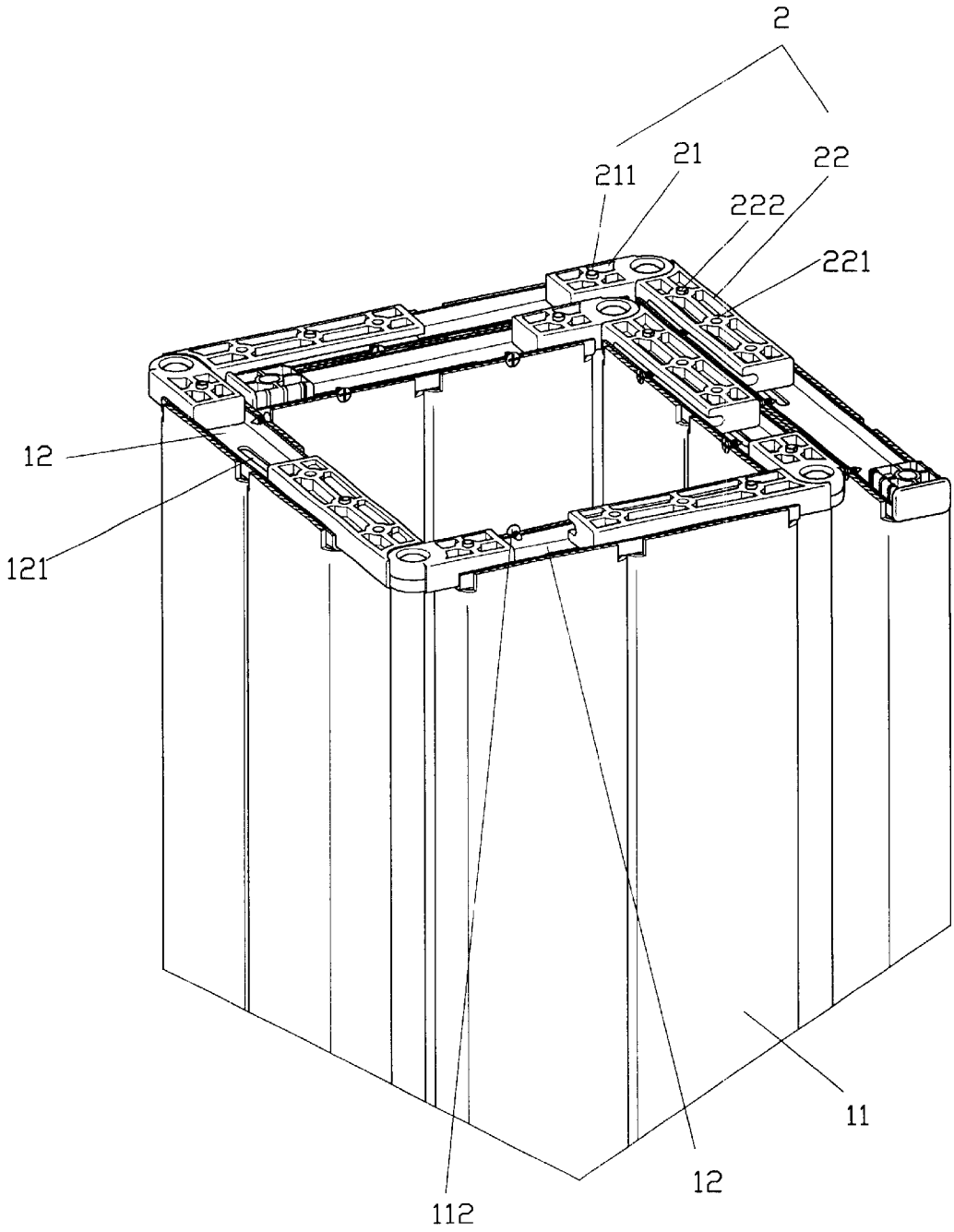
FIG. 8 is a view showing the tabletop in a folded status.

When folding the table of the present invention, as shown in FIG. 2, the tabletop 1 is flipped down until it has reached to one side of the legs 3, as shown in FIG. 6, and then the sleeves 32 and the blocks 52 and 53 are slid, thus the legs 3 are all collapsed together. Meanwhile, the blocks 22 are slid along the rails 12 to gain gaps between each pipe 11 so that the pipes 11 may be folded to the smallest size as shown in FIGS. 7 and 8.

I claim:

1. A folding table comprising a tabletop, joints, legs, a connecting device, and auxiliary supporting devices, said tabletop being formed with pipes connected together, said legs comprising two sleeves with one sleeve able to slide on said leg and connected with said auxiliary supporting devices, each said auxiliary supporting device being secured between every two adjacent legs and linked with said legs, said connecting device being secured at one end of said legs to be connected with said tabletop for rotation, said tabletop being formed with pipes and rails, each said pipe having a set of connected rails, said rails being connected by a collapsible joint, said joint having one end secured to one said rail, and another end of said joint being secured to said adjacent rail, said joint including a connected pair of blocks extending respectively into said connected rails, each said auxiliary supporting device comprising at least one linking block connected by posts to said sleeves between adjacent legs, at least one of said blocks engaging with a bottom end of said tabletop upon spreading the legs and auxiliary supporting devices being disposed to provide support for said tabletop.

2. The table, as recited in claim 1, wherein said auxiliary supporting device is formed with a pair of posts in cross connection with blocks on the adjacent ends of said posts.

* * * * *